US006298560B1

(12) United States Patent
Lee

(10) Patent No.: US 6,298,560 B1
(45) Date of Patent: Oct. 9, 2001

(54) SHEAR ASSEMBLY

(75) Inventor: Won-Hae Lee, Seoul (KR)

(73) Assignee: Daemo Engineering Co., Ltd., Seoul (KR)

( * ) Notice: Subject to any disclaimer, the term of this patent is extended or adjusted under 35 U.S.C. 154(b) by 0 days.

(21) Appl. No.: 09/533,967

(22) Filed: Mar. 23, 2000

(51) Int. Cl.[7] ..... B02C 1/06
(52) U.S. Cl. ..... 30/134; 241/101.73
(58) Field of Search ..... 30/134, 228; 241/101.73

(56) References Cited

U.S. PATENT DOCUMENTS 4,961,543 * 10/1990 Sakato et al. ..... 241/101.73 X 5,894,666 * 4/1999 Hrusch ..... 30/134

* cited by examiner

*Primary Examiner*—Douglas D. Watts
(74) *Attorney, Agent, or Firm*—Robert E. Bushnell, Esq.

(57) ABSTRACT

A shear assembly including a bracket unit detachably to an excavator is provided. The shear assembly includes a main body rotatably attached to a bracket unit, a rotating unit disposed between the main body and the bracket unit to rotate main body around the bracket unit, a fixed arm unit fixed to the main body, a moving arm unit rotatably mounted on the main unit and opened from and closed toward the fixed arm unit, a cylinder unit rotatably mounted on the main body and rotating the moving arm unit.

28 Claims, 9 Drawing Sheets

SHEAR ASSEMBLY

BACKGROUND OF THE INVENTION

1. Field of the Invention

The present invention relates to a shear assembly, and more particularly, to a shear assembly detachably attached to a boom of an excavator.

2. Description of the Related Art

A shear assembly has been detachably attached to a boom of an excavator or a mobile vehicle for cutting off a workpiece. Typically, during attaching the shear assembly to the boom, complicated mechanisms of the shearing assembly should be connected to the other mechanism of the boom in order to operate at least two jaws mounted on the shear assembly. Due to these complicated mechanisms connected between the shear assembly and the boom, the shear assembly can not be easily attached to the mechanism of the boom, and it is very difficult for a user to detach the shear assembly from the boom. Therefore, I have noticed that these complicated shear assemblies can not be easily attached to the boom.

Moreover, the complicated connections between the shear assembly and the boom of the excavating device can be easily damaged and broken while using the shear assembly. The shear assembly should be replaced when any one of the connecting mechanisms between the shear assembly and the boom of the excavating device is damaged. In this instance, the user has to dissemble several complicated mechanisms connected between the shear assembly and the boom and attach all of these mechanism of a new shear assembly to the boom of the excavator. It is very dangerous for the user to detach the damaged shear assembly and attach the replacement to the boom of the excavator because it is too heavy for the user to manually move and connect the devices. Moreover, the assembly may be damaged or the user injured during changing and replacing these devices and connecting the complicated mechanisms.

SUMMARY OF THE INVENTION

It is an object of the present invention to provide a shear assembly suitable to be easily attached to a boom of an excavating device or a mobile vehicle.

It is another object to provide a shear assembly able to prevent the mechanism of the shear assembly from being damaged during the operation of the shear assembly.

It is still another object to provide a shear assembly able to provide a compact and convenient mechanism of the shear assembly attached to the boom of the excavating device.

It is still yet another object to provide a shear assembly amenable to easy assembly and disassembly.

It is further object to provide a shear assembly able to operate without complicated connection mechanisms between the boom and the shearing assembly.

It is another further object to provide a shear assembly able to provide a durable connection between a cylinder and an external fluid source and between the rotatable mechanism and stationary mechanism of the shear assembly.

These and other objects may be achieved by using a shear assembly attached to an excavator or a mobile vehicle. The shear assembly includes a bracket unit detachably attached to the excavator, a main body rotatably attached to the bracket unit, a rotating unit disposed between the main body and the bracket unit to rotate the main body around the bracket unit, a fixed arm unit connected to the main body, a moving arm unit rotatably mounted on the main unit and opened from and closed toward the fixed arm unit, and a cylinder unit rotatably mounted on the main body, and rotating the moving arm unit.

A plurality of boom holes formed on each bracket of the bracket unit are coupled to a rigid boom of the excavator or a mobile vehicle so as to securely mount the shear assembly on either the excavator or a mobile vehicle. A motor, such as a hydraulic motor or electric motor, mounted on a turntable of the rotating unit rotates the main body. A pinion formed on a shaft coupled to the motor is meshed with gear teeth formed on the inside of a swing gear fixed to a connecting plate of the main body. A swing gear guide is fixed to the turntable, and a connecting plate of the main body connected to the motor is disposed within the swing gear guide to rotate around the bracket unit when driven by the motor.

A center joint unit used for providing passageways of the fluid material supplied from outside of the shear assembly to the cylinder includes a fixed coupler attached to the turntable and rotatably inserted into a hole formed on an central portion of the connecting plate of main body and a movable coupler rotatably inserted into a central hollow formed on a central portion of fixed coupler. A plurality of conduits formed on the fixed coupler and the moving coupler are coupled to each other in order to form the passageway while the movable coupler rotates relative to the bracket, the main body, and the fixed coupler. A protrusion formed on a stop ring fixed to the connecting plate of the main body is inserted into a recess formed on the movable coupler of the centerjoint thereby, guiding the movable coupler while the center joint moves relative to the main body and the bracket.

A pair of supports of the main body extend from the connecting plate. The fixed arm unit is disposed between and fixed to the supports by pins. The moving arm unit is rotatably coupled to the support by a fixing pin and rotates about an axis passing through a center of the fixing pin.

The cylinder unit is rotatably mounted on support by a cylinder pin and rotates about an axis passing though a center of the cylinder pin. A center joint unit is disposed on the rotating unit to supply a fluid material to the cylinder through holes formed on a center area of the turntable and the connecting plate. A fixed coupler having a plurality of fluid conduits is attached to the turntable. A rotatable coupler is disposed on a cylindrical hollow formed on the fixed coupler to receive the fluid material from the fluid conduit through circular conduits, a redial conduit, and longitudinal conduits formed on the rotatable coupler. A plurality of stoppers attached to the connecting plate support and guide the rotatable coupler. A plurality of protrusions formed on the stoppers are inserted into formed on the fixed coupler. A plurality of hoses are coupled between the longitudinal conduits of the rotatable coupler and fluid couplers of the cylinder.

The moving arm body of the moving arm unit is connected to the cylinder unit by a moving pin. An upper blade is located in a lower blade recess. Screws attach the upper blade to an upper jaw of the moving arm unit while a lower blade is attached to a lower jaw of the fixed arm unit by screws. Screws couple a guide blade inserted into a guide recess to the lower jaw. An end recess is formed on the lower jaw to guide an end of the upper jaw when the upper jaw is inserted into an lower recess.

BRIEF DESCRIPTION OF THE DRAWINGS

A more complete application of this invention, and many of the attendant advantage thereof, will be readily apparent as the same becomes better understood by reference to the following detailed description when considered in conjunction with the accompanying drawing in which like reference symbols indicate the same or similar components, wherein.

DESCRIPTION OF THE PREFERRED EMBODIMENT

Figure 1:
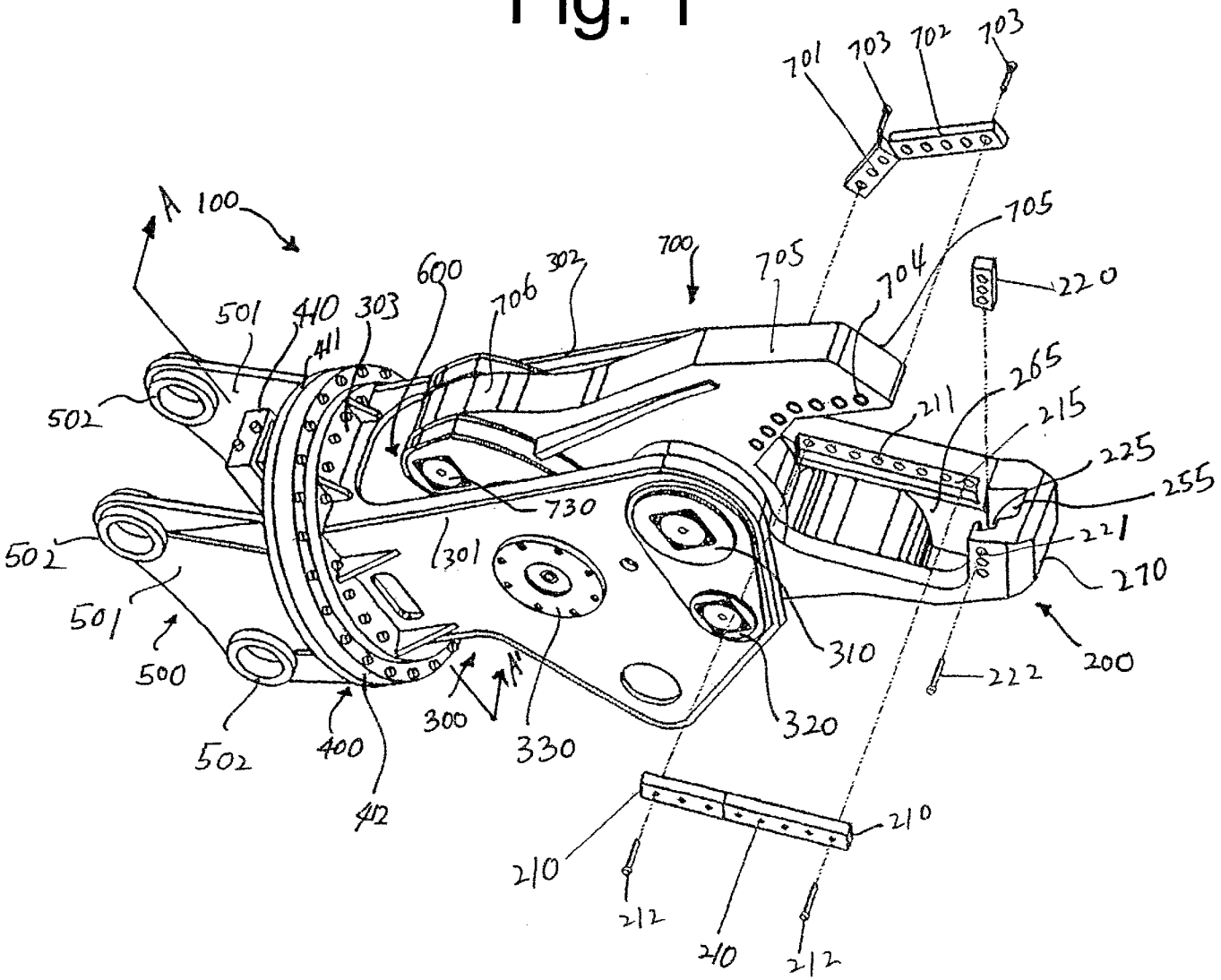
FIG. 1 is a perspective view of a shear assembly constructed according to the principles of the present invention.

Referring now to FIG. 1, a shear assembly 100 includes a bracket unit 500 attached to an arm or a dipper stick of an excavator (not shown), a main body 300 rotatably attached to bracket unit 500, a rotating unit 400 disposed between main body 300 and bracket unit 500 to rotate main body 300 around bracket unit 500, a stationary arm unit 200 fixed to main body 300, a moving arm unit 700 rotatably mounted on main body 300 and opened from and closed toward stationary arm unit 200, a cylinder unit 600 rotatably mounted on main body 300 and rotating moving arm unit 700.

A plurality of stick holes 502 formed on each bracket 501 of bracket unit 500 are coupled to the articulated boom of the excavator or a mobile vehicle not shown so as to fixedly mount shear assembly 100 to the excavator or a mobile vehicle. A motor 410, such as a hydraulic motor, mounted on a turntable 411 of rotating unit 400 rotates main body 300. A swing gear guide 412 is bolted to turntable 411, and a connecting plate 303 of main body 300 is operationally connected to motor 410 and is disposed within swing gear guide 412 to be rotated around bracket unit 500 by motor 410. A pair of supports 301, 302 of main body 300 extend from connecting plate 303. Stationary arm unit 200 is disposed between and attached to supports 301,302 by pins 310,320. Moving arm unit 700 is rotatably coupled to support 301, 302 by pin 310 and rotates about an axis passing through a center of pin 310. Cylinder unit 600 is rotatably mounted on supports 301, 302 by a cylinder pin 330 and rotates about an axis passing though a center of cylinder pin 330.

Moving arm body 706 of moving arm unit 700 is connected to cylinder unit 600 by a moving pin 703. An upper blade 702 is located in a lower blade recess 215. Screws 703 coupled to holes 704 attaches upper blade 702 to an upper jaw 705 of moving arm unit 700 while a lower blade 210 is attached to a lower jaw 270 of stationary lower arm unit 200 by screws 212 threaded into holes 211. Screws 222 are inserted into holes 221 and couple a guide blade 220 inserted into a guide recess 225 to lower jaw 270. An end recess 255 is formed on lower jaw 270 to accommodate an end of upper jaw 704 when upper jaw 705 is received into an lower recess 265.

Figure 2:
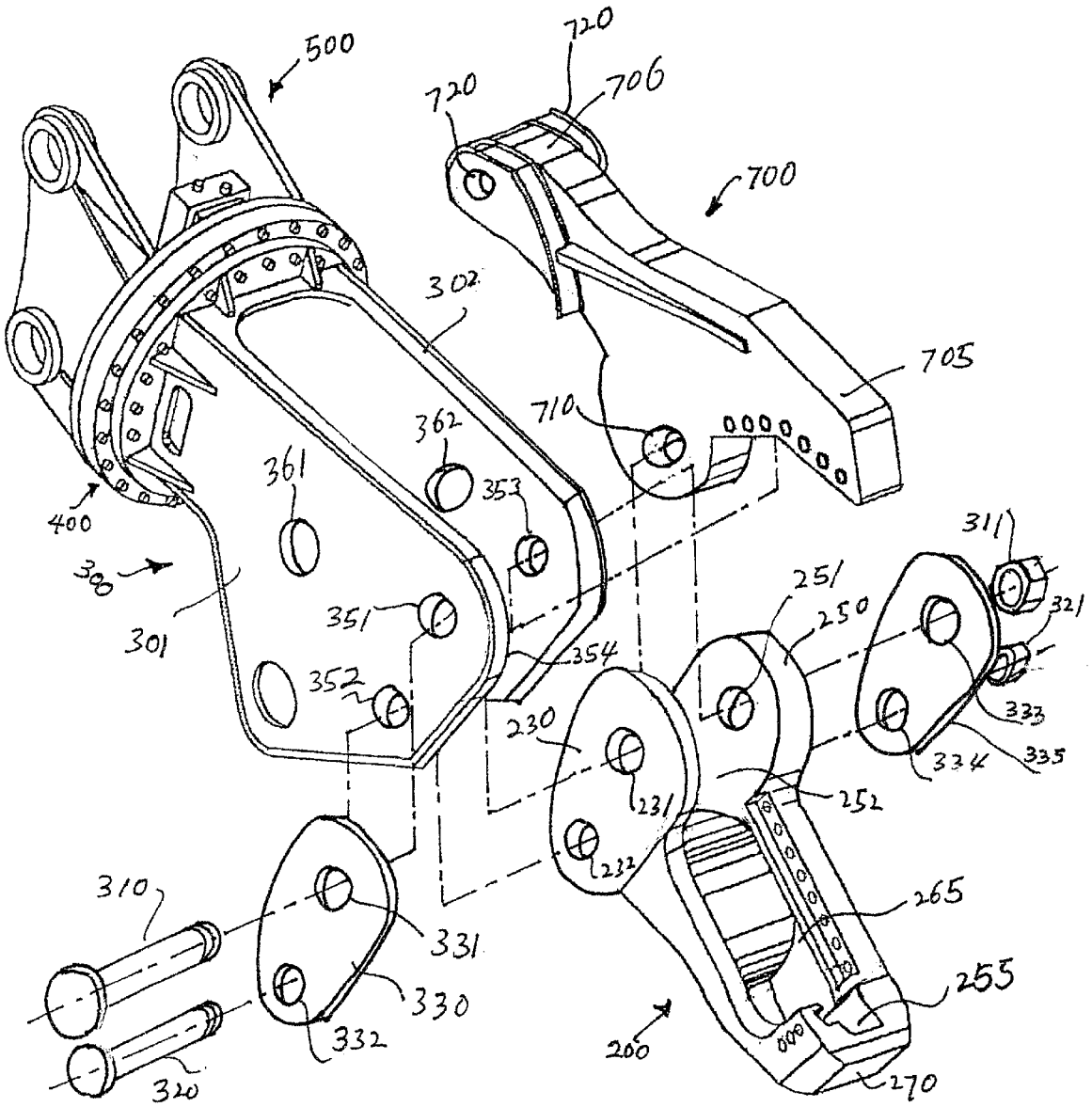
FIG. 2 is a perspective view showing a stationary arm and a moving arm assembled into a main body in the shear assembly.

FIG. 2 shows stationary arm unit 200 and moving arm unit 700 assembled with main body 300 of shear assembly 100. A pin 310 coupled to a nut 311 is inserted into a side hole 331 of a side plate 330, an arm supporting hole 351 of main body 300, hole 231 of stationary arm unit 200, a rotating hole 710 of moving arm unit 700, hole 251 of stationary arm unit 200, an arm supporting hole 353 of main body 200, and a side hole 333 of side plate 335 while another pin 320 coupled to another nut 321 is inserted into a side hole 332 of side plate 330, an arm supporting hole 352 of main body 300, holes 232,252 of stationary arm unit 200, an arm supporting hole 354 of main body 300, and a side hole 334 of side plate 335. Moving arm unit 700 is freely rotatable about an axis passing through a center of stationary pin 310 in a direction of arrows E or F between a closed position and an open position while stationary arm unit 200 is fixed to main body 300 by pins 310, 320. Upper jaw 705 is received in upper jaw-end recess 255 and upper jaw recess 265 of lower jaw 270 when moving arm unit 700 rotates about the axis of pin 310.

Figure 3:
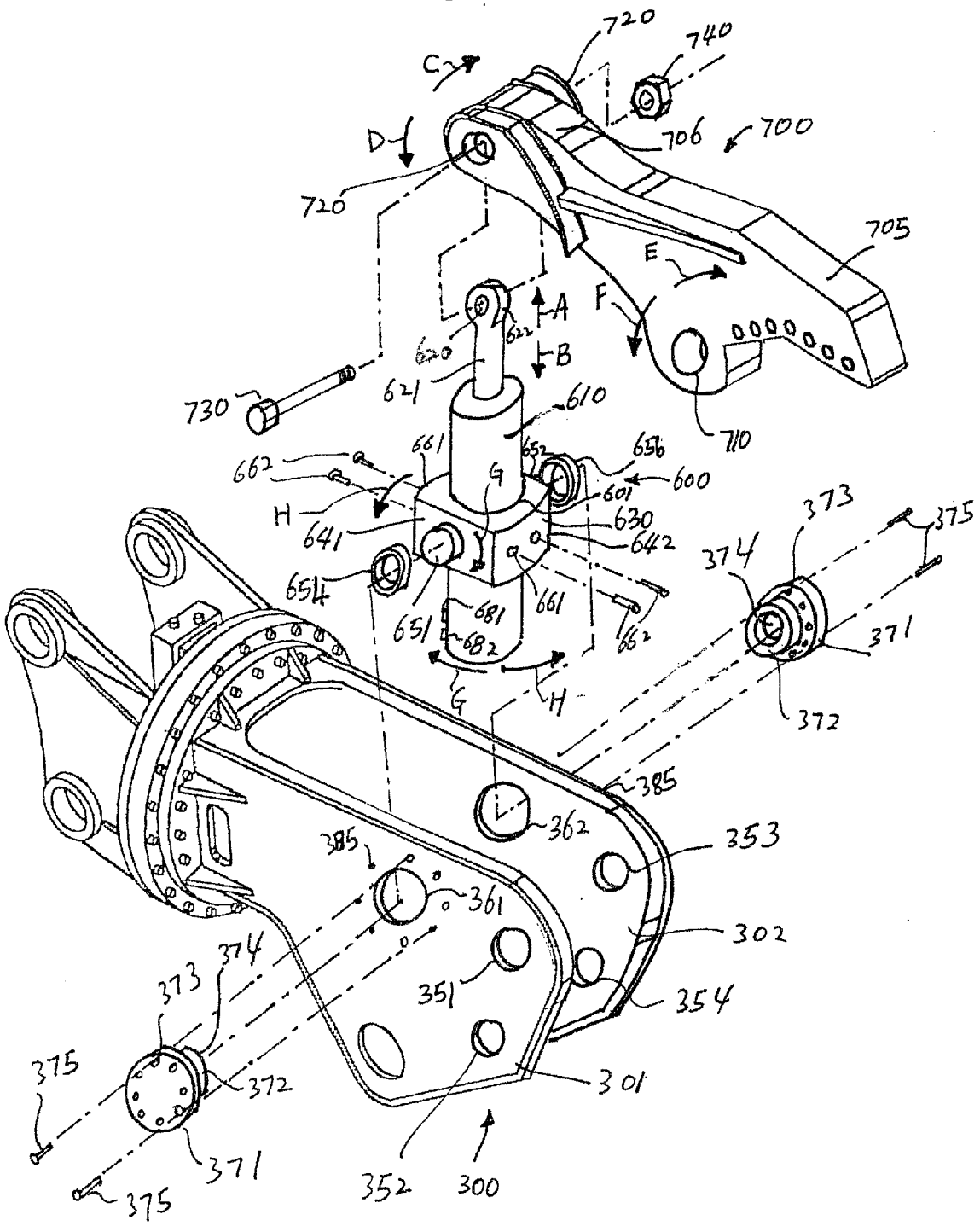
FIG. 3 is a perspective view showing a cylinder unit and a moving arm unit assembled into the shear assembly.

FIG. 3 shows cylinder unit 600 and moving arm unit 700 assembled into main body 300 of shear assembly 100. A cylinder 610 includes a cylinder rod linearly and reciprocally moving into and from cylinder 610 in a direction of arrows A or B. A rod hole 620 is formed on one rod end 622 of cylinder rod 621 and is inserted between holes 720 formed on rotatable main body 706 of moving arm unit by using pin 730 coupled to a nut 740. When piston rod 621 is extended from cylinder 610 in the direction of arrow A, one end of moving arm body 706 coupled to cylinder rod 621 rotates in a direction of arrow C, thereby rotating moving arm unit 700 in the direction of arrow E. On the contrary, when piston rod 621 is retracted into cylinder 610 in the direction of arrow B, the end of moving arm body 706 rotates in a direction of arrow D, thereby rotating moving arm unit 700 in the direction of arrow F.

Cylinder 610 is inserted into a cylinder hole 601 formed on a cylinder bracket 630 and fixed to cylinder bracket 630 by inserting and fastening screws 662 into holes formed on cylinder 610 not shown through holes 661 formed on cylinder bracket 630. A pair of axles 651,652 are formed on a plurality of opposite surfaces 641,642 of cylinder bracket 630. Washers 654,656 are inserted into outer circumferential surfaces of axles 651, 652. Cylinder supporting holes 361, 362 are formed on supports 301,302 while a plurality of holes 385 are formed around cylinder supporting holes 361, 362. A pair of cylinder stoppers 371 include a plurality of holes 373 and a boss 372 having a bore 374 formed inside of boss 372 accommodating the insertion of axle 651,652 of cylinder bracket 630. Cylinder unit 600 is disposed between supports 301, 302 to be coupled to cylinder stoppers 371. Cylinder stoppers 371 are inserted into cylinder supporting holes 361, 362 while axles 651, 652 are inserted into each corresponding bore 374 of cylinder stoppers 371. Screws 375 couple each cylinder pin 371 to each support 301, 302 through holes 373 while axles 651, 652 are inserted into each corresponding bore 374 of cylinder stoppers 371. Cylinder unit 600 freely rotates about a second axis passing through a center of cylinder stopper 371 in a direction of arrows G or H. A plurality of fluid couplers 681, 682 are formed on cylinder 610 to supply fluid material into cylinder 610, thereby reciprocally moving cylinder rod 621 in the direction of arrow A or B.

When cylinder rod 621 moves in the direction of arrow A, cylinder rod 621 pushes the end of moving arm body 706 in the direction of arrow C, and simultaneously cylinder 610 rotates in the direction of arrow G about the second axis of axle 651 in response to the reaction of the pushing force of cylinder rod 610 because moving arm unit 700 is rotatably coupled to supports 301, 302 through fixing pin 310 and coupled to one end of cylinder 610 through cylinder rod 621. Therefore, moving arm unit 700 rotates about the first axis of fixing pin 310 in the direction of arrow E to its closed position. On the contrary, when cylinder rod 621 moves in the direction of arrow B, cylinder rod 621 pulls the end of moving arm body 706 in the direction of arrow D, and simultaneously cylinder 610 rotates in the direction of arrow H about the second axis of axles 651 in response to the reaction of the pulling force of cylinder rod 610 because moving arm unit 100 is rotatably coupled to supports 301, 302 by pin 310 and coupled to one end of cylinder 610 through cylinder rod 621. Therefore, moving arm unit 700 rotates about the first axis of fixing pin 310 in the direction of arrow F to its open position.

Figure 4:
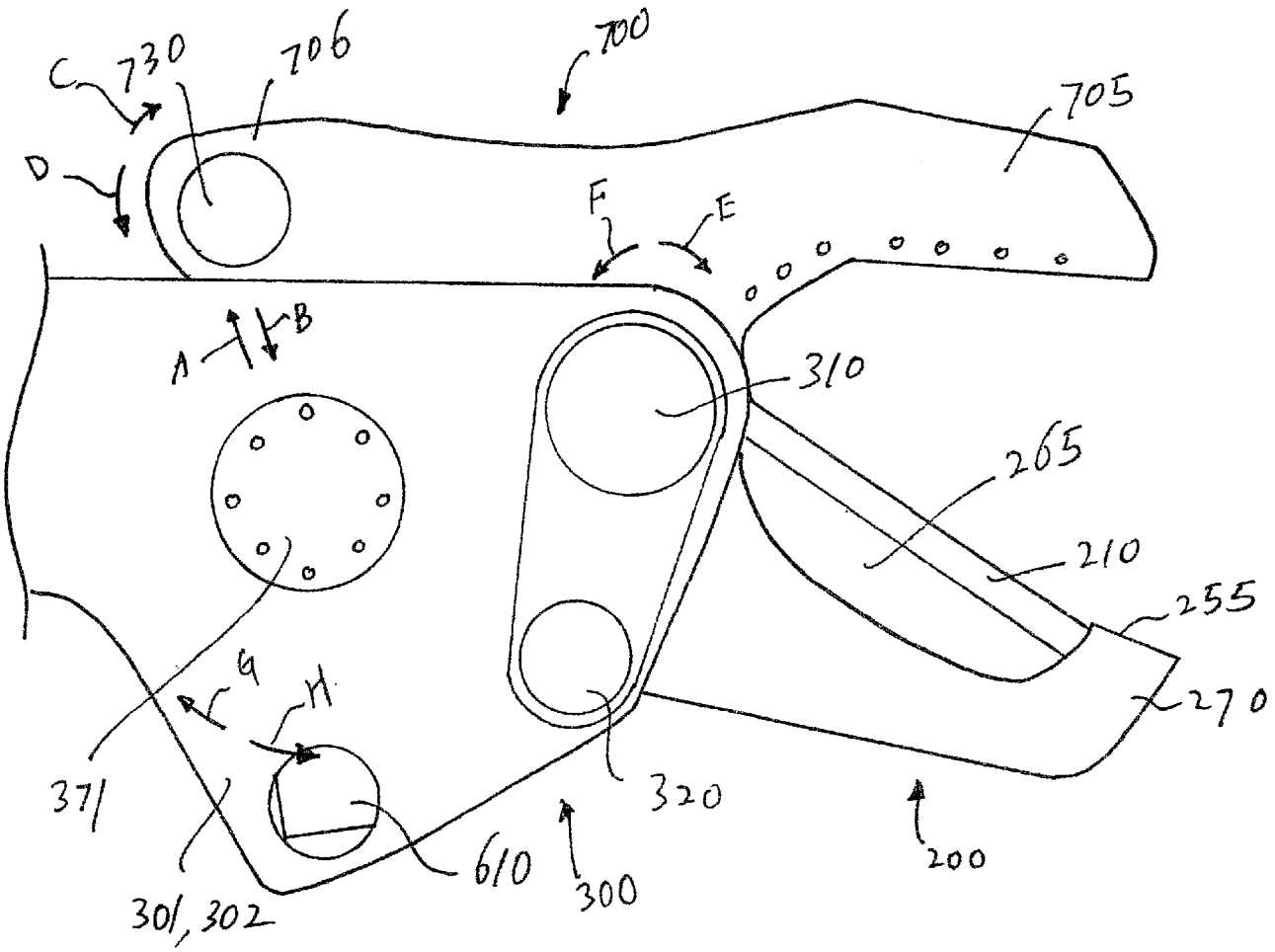
FIG. 4 is a front view of the shear assembly showing an open state of the upper and lower jaws.
Figure 5:
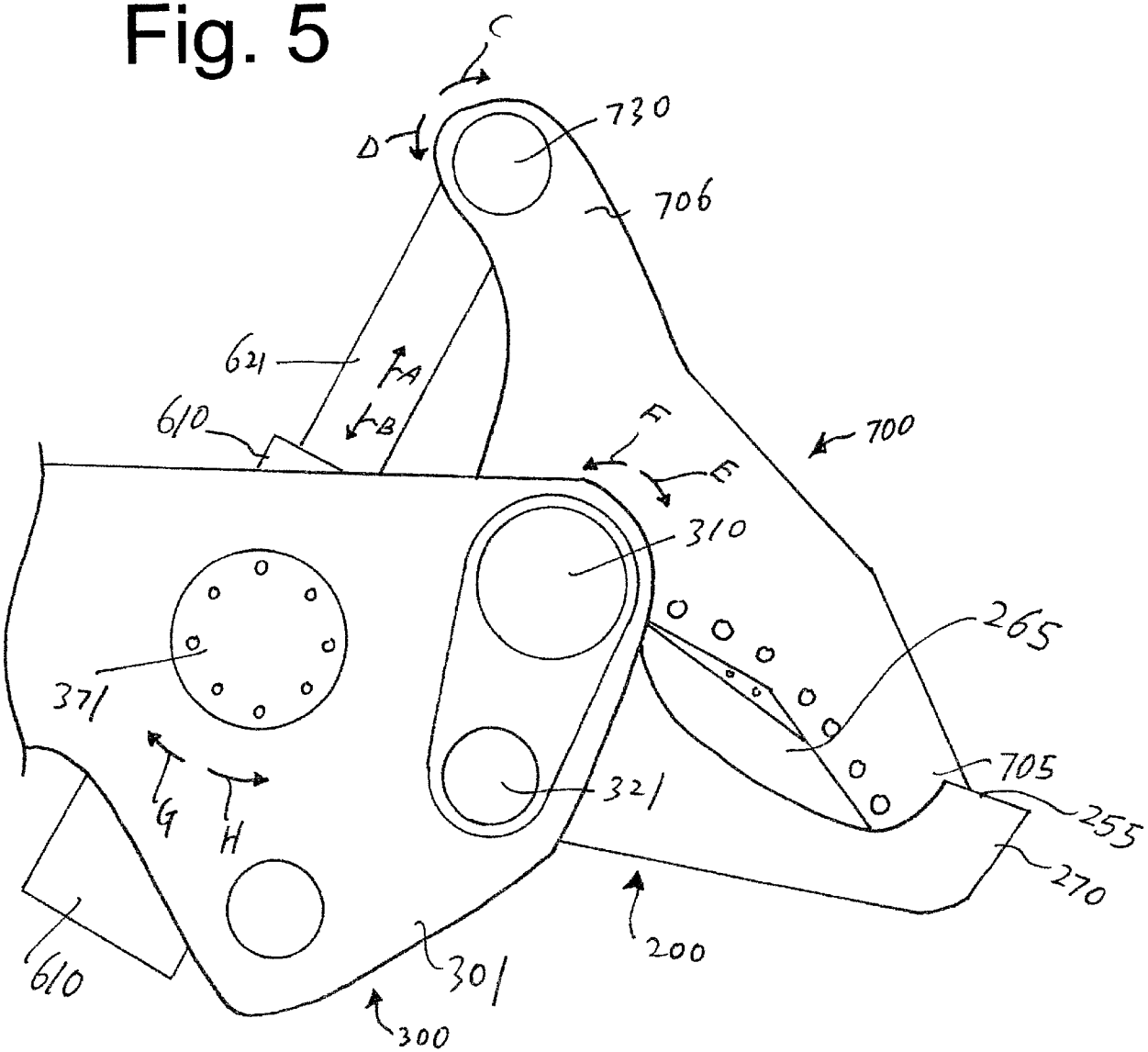
FIG. 5 is a front view of the shear assembly showing a closed state of the upper and lower jaws.

FIGS. 4 and 5 show the closed position and the open position of fixed and moving arm units 200 and 700. In the open position, a workpiece such as a steel rod may be positioned between upper blade 702 of upper jaw 705 and lower blade 210 of lower jaw 270. In response to the supply of the pneumatic or hydraulic fluid material into the cylinder 610 through fluid coupler 681, 682 and the activation of the cylinder 610, cylinder rod 621 reciprocally moves in the direction of either arrow A or B while cylinder 610 rotates about the second axis passing through the center of cylinder stopper 371 in the direction of either arrow G or H, and moving arm unit 700 rotates about the first axis passing through the center of fixing pin 310 in the direction of either arrow E or F. Upper blade 702 of upper jaw 705 and lower blade 210 of lower jaw 270 cut and completely sever the workpiece when upper blade 702 of upper jaw moves from the open position to the closed position. After cutting the workpiece, the upper jaw 705 is received into lower jaw 270 while the end of upper jaw 705 is received into upper jaw-end recess 255 of lower jar 270 as shown in FIG. 5.

Figure 6:
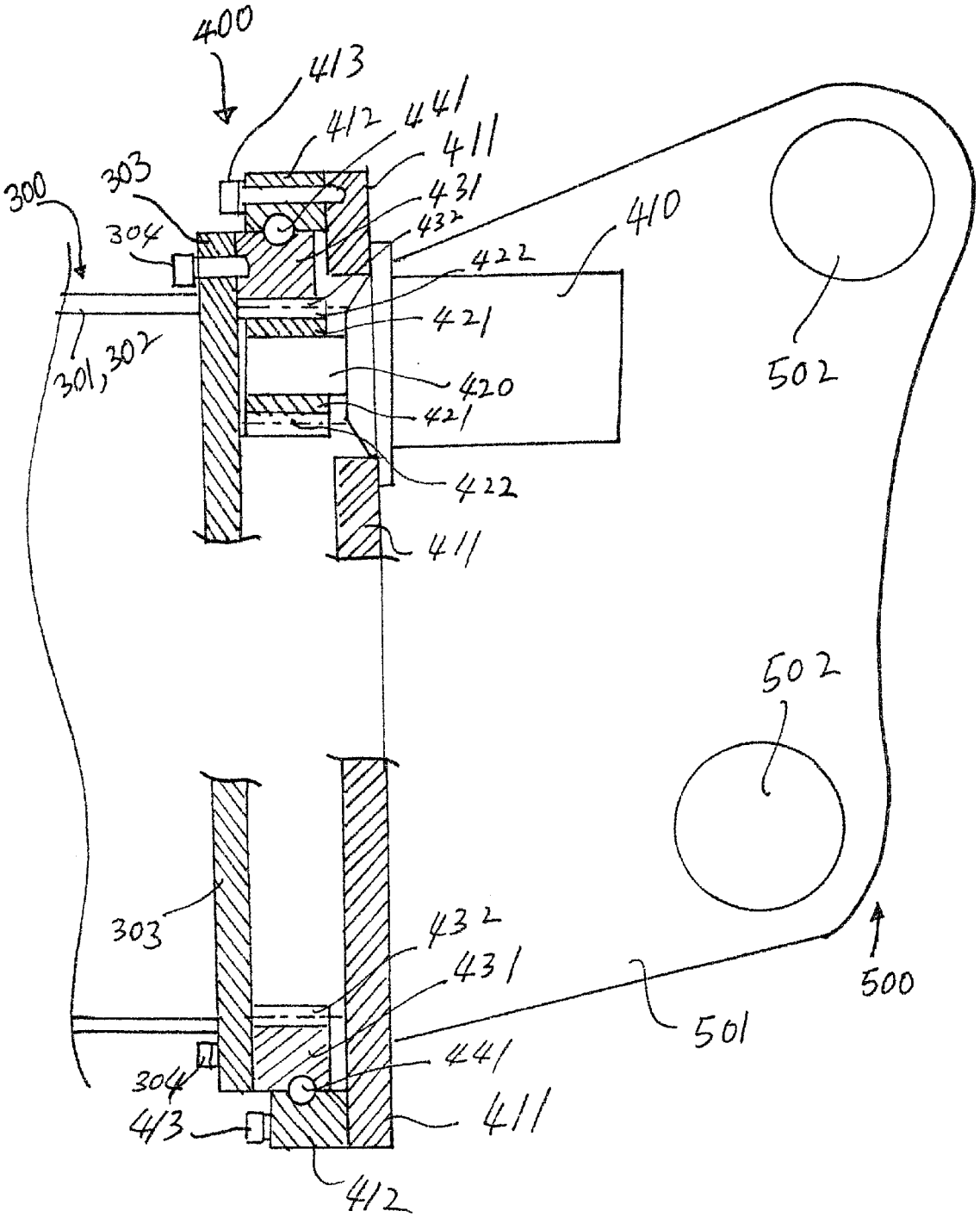
FIG. 6 is a partial cross-sectional view showing a rotating unit taken along A–A' of FIG. 1.

Rotating unit 400 shown in FIG. 6 includes motor 410 mounted on turntable 411. A pinion 421 having outer gear teeth 422 is formed on outer circumferential surface of a motor shaft 420 extending from motor 410, and rotates by motor 410. Inner gear teeth 432 formed on the inner circumferential surface of a swing gear 431 is meshed with outer gear teeth 422 of pinion 421. A swing gear guide 412 attached to turntable 411 by screws 413 is coupled to swing gear 431 through ball bearings 441 disposed between swing gear 432 and swing gear guide 412, and guides swing gear 431 to freely rotate about a third axis passing through a center of both turntable 411 attached to bracket unit 500 and a connecting plate 303 of main body 300 within the inside of swing gear guide 412. Screws 304 couple swing gear 431 to connecting plate 303 of main body 300. When pinion 421 is rotated by motor 410, swing gear 431, which is coupled to pinion 421, rotates. Therefore, main body 300 rotates relative to bracket unit 500 attached to the boom of the excavator or a fixed arm of the mobile vehicle.

Figure 7:
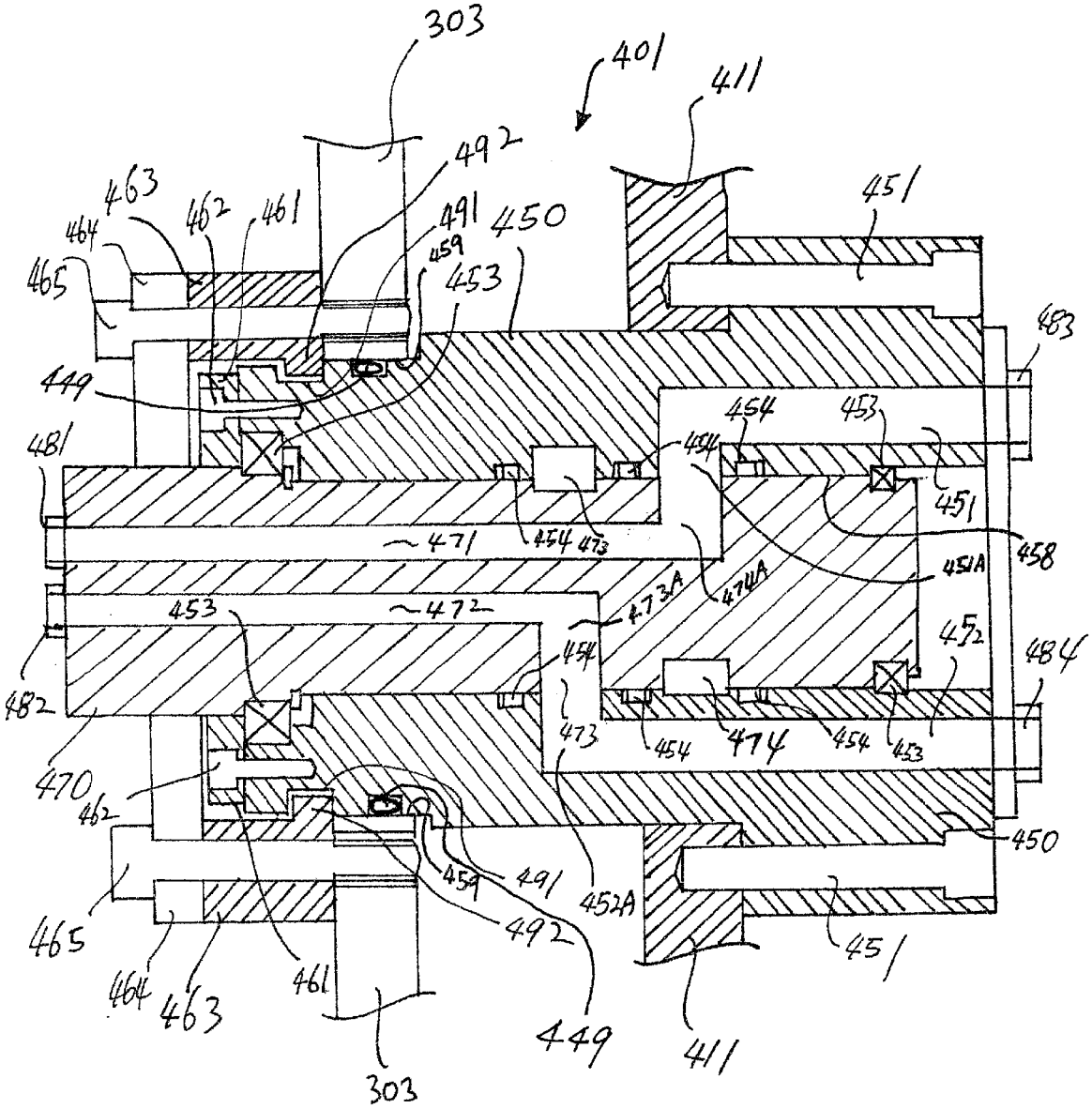
FIG. 7 is a partial cross-sectional view showing a center joint unit of the rotating unit taken along A–A' of FIG. 1.

FIG.7 shows a center joint 401 of rotating unit 400. Center joint unit 401 is used for providing passageways for the operating fluid material supplied from outside of shear assembly 100 to cylinder 610 of cylinder unit 600. Center-joint unit 401 includes a fixed coupler 450 attached to turntable 411 and rotatably inserted into a hole 459 formed on an central portion of connecting plate 303 of main body 300, and a movable coupler rotatably inserted into a central hollow 458 formed on a central portion of fixed coupler 450. A ring 449 is disposed between inside surface of hole 459 of connecting plate 303 and outside surface of fixed coupler 450 in order to prevent water leakage. Fixed coupler 450 includes a plurality of inlets 483, 484 receiving the operating fluid from an external source, first longitudinal conduits 451, 452 coupled to inlets 483, 484, and first radial conduits 451A, 452A coupled to the first longitudinal conduits 451, 452. By inserting ring 449 between a hole in connecting plate 303 and fixed coupler 450 and ball bearing 441, or another ring between swing gear 431 and swing gear guide 412, water leakage is prevented from outside of connecting plate 303 and turntable 411 to the interior between connecting plate and turntable 410. This protects swing gear 431 is prevented from being damaged by water leakage.

A movable coupler 470 is disposed inside of the hollow of fixed coupler 450 to be rotatably coupled to fixed coupler 450 through bearings 453 and rings 454 inserted between fixed coupler 450 and movable coupler 470. A pair of second longitudinal conduits 471, 472 are formed inside of movable coupler 470 and connected to outlets 481,482 respectively. Circular conduits 473,474 are formed on an outer circumferential surface of movable coupler 470, and second radial conduits 474A, 473A is disposed between second longitudinal conduits 471, 472 and circular conduits 473, 474 to couple circular conduits 473, 474 to second longitudinal conduits 471, 472. The circular conduits 473, 474 are disposed to connect first radial conduits 451A, 452A of fixed coupler 450 to second radial conduits 474A, 473A of movable coupler 470 while movable coupler 470 rotates within the inside of the hollow 459, thereby forming the passageway of the operating fluid from inlets 483,484 to outlets 481,482 through first longitudinal conduits 451,452 coupled to inlets 483, 484, first radial conduits 451A, 452A in fixed coupler 450, circular conduits 474, 473, second radial conduits 474A, 473A, second longitudinal conduits 471, 472 in movable coupler 470 coupled to outlets 481, 482, respectively.

Stop rings 463 are attached to rotatable connecting plate 303 of main body 300 by bolts 465 and stoppers 464. Stop rings 463 and stopper 464 prevent main body 300 from being dissembled and dropped from the arm or the boom and bracket unit 500 when bolt 304 or swing gear 431 are broken. Protrusions 492 formed on an inner circumferential surface of stop ring 463 are inserted into recesses 491 formed on an outer circumferential surface of fixed coupler 450, thereby supporting fixed coupler 450 while connecting plate 303 rotates relative to fixed coupler 450. One end of stopper 464 is disposed to contact an outer circumferential surface of movable coupler 470 and to guide the rotation of movable coupler 470 while movable coupler 470 rotates relative to connecting plate 303 and fixed coupler 450. Outlets 481, 482 of movable coupler 470 are connected to fluid couplers 681, 682 of cylinder 610, respectively. The passage ways from inlets 484, 484 to fluid couplers 681,682 through outlets 481,482 are formed while movable coupler 470 moves with main body 300.

Figure 8:
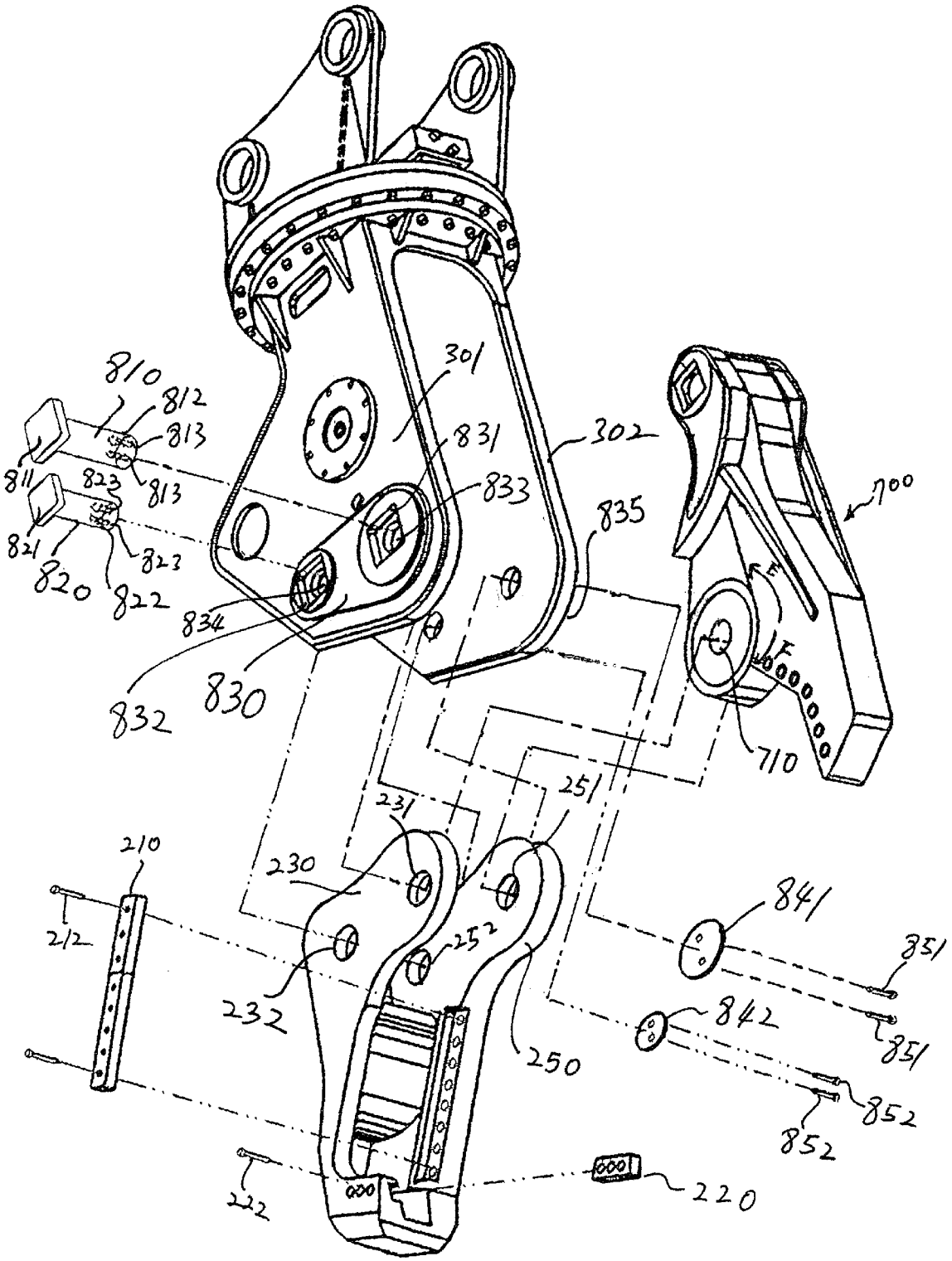
FIG. 8 is a perspective views showing an embodiment of a stationary arm and a moving arm unit assembled into a main body in the shear assembly.

FIG. 8 shows another embodiment of pins 810, 820, side plates 830, 835, and side couplers 841, 842. Side plates 830, 835 are fixed to supports 301, 302. Circular holes 833, 834 and rectangular holes 831, 832 are formed on side plates 830, 835. Pins 810, 820 having shanks 812, 822, are inserted into circular holes 833, 834 respectively while rectangular heads 811, 812 are disposed in rectangular holes 831, 832. Therefore, pins 810, 820 do not rotate while moving arm unit 700 rotates about the first axis passing through the center of pin 810 because rectangular holes 831, 832 prevent rectangular head 811, 812 from rotating. After shank 812 of pin 810 is inserted into circular hole 833 of side plate 830, hole 231, rotating hole 710, hole 251, and circular hole 833 of sideplate 835. Bolts 851 inserted through holes 813 formed on pin 810 through side coupler 841. At the same time, screws 852 are coupled to screw holes 823 formed on pin 82 through side coupler 842 after shank 822 of pin 820 is inserted into circular hole 834 of side plate 23 1, rotating holes 232, 252, and circular hole 834 of side plate 835.

Figure 9:
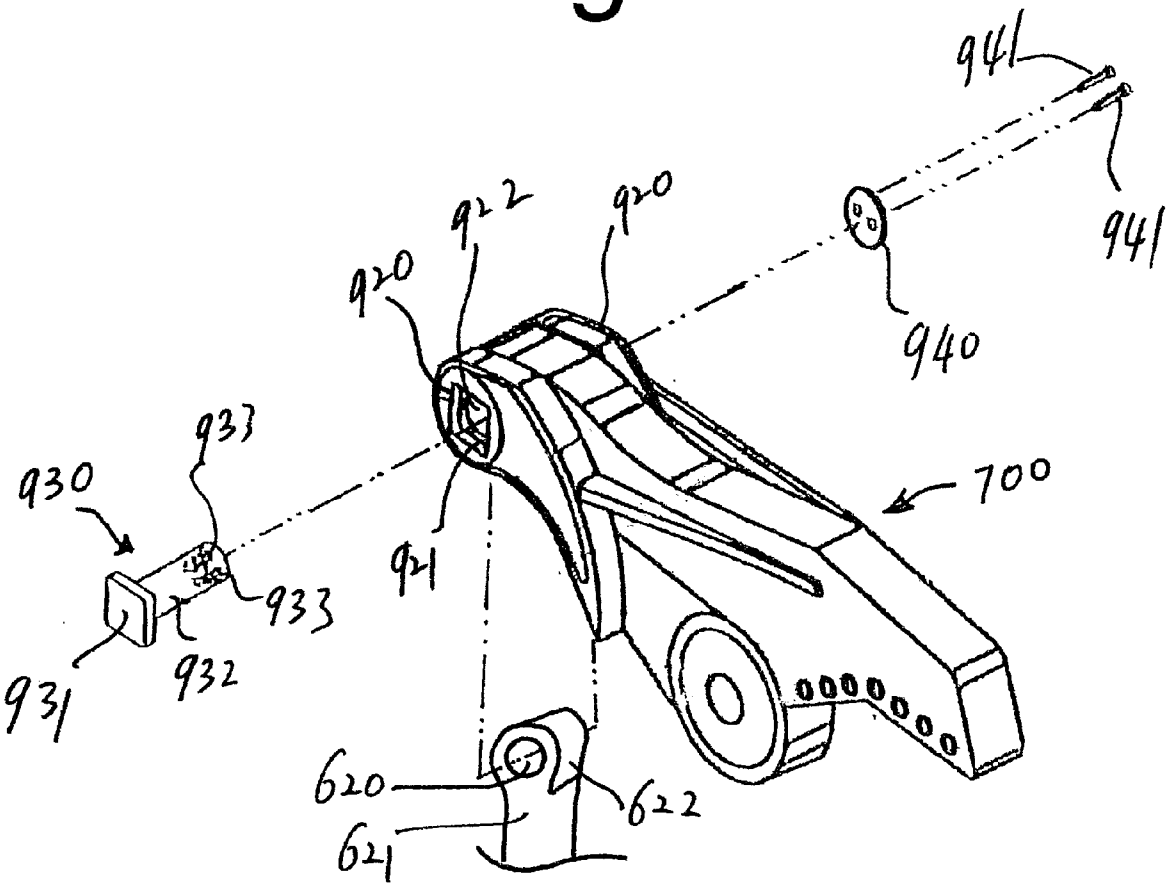
FIG. 9 a perspective view showing an embodiment of a moving arm unit assembled with a cylinder rod.

FIG. 9 shows another embodiment of moving pin 930. Rectangular head 931 and a plurality of holes 933 are formed on each end portion of shank 932 of moving pin 930. A circular hole 922 and a rectangular hole 921 are formed on moving hole 920 in each side of moving arm unit 700. After shank 932 is inserted into circular hole 922, rod hole 620 formed on a rod end 622 of cylinder rod 621, and another circular hole 922, bolts 941 are inserted into holes 933 through a side coupler 940. Since rectangular head 931 is disposed in rectangular hole 921, moving pin 930 does not rotate while cylinder rod 621 and moving arm unit 700 rotate about the second axis.

According to the principles of this invention, the shear assembly can be detachably attached to the boom of the excavator without connecting any other mechanism between the shear assembly and the boom of the excavator. A bracket attached to the boom, a main body rotatably attached to the bracket, a fixed arm fixed to the main body, a cylinder rotatably attached to the main body, and a movable arm rotatably attached to the main body and coupled to the cylinder are included in the shear assembly. A rotating unit attached to the bracket rotates the main body relative to the boom. A center joint is disposed on an center portion of the rotating unit to provide a passageway for pneumatic or hydraulic operating fluid applied under pressure to the cylinder, while the cylinder rotates relative to the main body and the bracket in response to the introduction of that fluid, and the main body then rotates relative to the bracket and the boom. Therefore, this shear assembly may be attached to the boom of the excavator without connecting any other mechanism, such as a cylinder fixed to the boom, to the shear assembly during attachment of the shear assembly for operating the shear assembly. While this invention has been described in connection with what is presently considered to be the most practical and the disclosed embodiments, but it is to be understood that the invention is not limited to the disclosed embodiments, but, on the contrary, is intended to cover various modifications and equivalent arrangements included within the sprit and the scope of the amended claims.

What is claimed is:

1. A shearing apparatus, comprising:

a bracket attached to a boom of an external device, having a turntable;

a main body formed in a single body, having a connecting plate connected to said turntable of said bracket and a pair of supports extended from said connecting plate, said supports being parallel to each other;

a stationary arm attached to said supports, having a first blade, a first hole, and a second hole;

a moving arm rotatably attached to said supports, having a second blade, disposed to move between an open position for locating a workpiece between said first blade and said second blade and a closed position for cutting off the workpiece, having a third hole and a fourth hole;

a first pin attached to said supports, inserted into both said first hole of said stationary arm and said third hole of said moving arm, attaching said stationary arm to said supports, and attaching said moving arm to said supports;

a second pin attached to said supports, inserted into said second hole of said stationary arm, attaching said fixed arm to said supports;

a cylinder unit rotatably disposed between said supports, having a cylinderbracket, a cylinder fixed to said cylinder bracket, and a cylinder rod extended from said cylinder, having a pair of axles formed on opposite sides of said cylinder bracket and rotatably mounted on said supports;

a third pin inserted into both said fourth hole of said moving arm and a rod hole formed on one end of said cylinder rod, coupling said cylinder rod to said moving arm; and a rotating unit disposed between said bracket and said main body to rotatably couple said main body to said bracket, said rotating unit having a motor attached to said turntable of said bracket, a pinion connected to a shaft of said motor and rotating by said shaft of said motor, a swing gear attached to said connecting plate of said main body and rotating about an axis passing through a center of said turntable by said pinion, and a swing gear guide attached to said bracket and disposed on an outer circumferential surface of said swing gear to be slidably coupled to said outer circumferential surface of said swing gear.

2. The apparatus of claim 1, further comprising a pair of cylinder pins each inserted into a cylinder hole formed on each of said supports, said cylinder pins having a boss accommodating the insertion of one of said axles of said cylinder unit.

3. The apparatus of claim 2, wherein each of said cylinder pins is attached to said cylinder hole of said supports while each of said axles is rotatably inserted into said boss of each of said cylinder pins.

4. The apparatus of claim 1, with said swing gear disposed between said turntable and said connecting plate of said main body and said bracket.

5. The apparatus of claim 1, further comprising a ring inserted between said swing gear and said swing gear guide.

6. The apparatus of claim 1, further comprising a center joint connected to said connecting plate of said main body and said turntable of said bracket, having an inlet connected to an external fluid supply, an outlet connected to said cylinder, and a plurality of conduits formed on said center jointer.

7. The apparatus of claim 6, with said center joint comprising:

a fixed coupler inserted central holes formed on both said turntable and said connecting plate, fixed to said turntable, rotatably mounted on the hole of said connecting plate, having said inlet and a first conduit coupled to said inlet; and a moving coupler rotatably inserted into a hollow formed on said fixed coupler, having an outlet coupled to said cylinder and a second conduit coupled to said first conduit while said moving coupler rotates within said hollow of fixed coupler.

8. The apparatus of claim 6, with said moving coupler comprising a circular conduit formed on an outer circumferential surface of said moving coupler, coupling said first conduit of said fixed coupler to said second conduit of said moving coupler while said moving coupler rotates within said hollow of fixed coupler.

9. The apparatus of claim 6, further comprising a first stopper fixed to said connecting plate, having a protrusion inserted into a recess formed on outer circumferential surface of said fixed coupler.

10. The apparatus of claim 6, further comprising a second stopper fixed to said connecting plate of said main body, coupled to outer circumferential surface of said moving coupler.

11. The apparatus of claim 6, further comprising a ring inserted between an outer circumferential surface of said fixed coupler and an inner circumferential surface of said connecting plate.

12. A shearing apparatus, comprising:

a bracket detachably attached to an external device;

a main body formed in a single body, having a connecting plate connected to said bracket and a pair of supports extended from said connecting plate, said supports being parallel to each other;

a stationary arm fixed to said supports;

a moving arm rotatably attached to said supports, disposed to move between an open position and a closed position, rotating about a first axis passing through a center of a first pin coupling said moving arm to said supports;

a cylinder rotatably mounted between said supports, having a cylinder rod extended from said cylinder and coupled to one end of said moving arm, moving said moving between said closed position and said open position while said cylinder rotates about a second axis passing through a center of a second pin coupling said cylinder to said supports; and a rotating unit rotatably coupling said main body to said bracket, said rotating unit having a motor attached to a turntable fixed to said bracket, a pinion connected to a shaft of said motor and rotated by said shaft of said motor, a swing gear fixed to said connecting plate of said main body and rotating about an axis passing through a center of said turntable by said pinion, and a swing gear guide attached to said bracket, disposed an outer circumferential surface of said swing gear, and slidably coupled to said outer circumferential surface of said swing gear.

13. The apparatus of claim 12, with said first pin fixedly coupling said fixed arm to said supports and rotatably coupling said moving arm to said supports while a third pin couples said fixed arm to said supports.

14. The apparatus of claim 12, further comprising a pair of cylinder pins inserted into cylinder holes formed on said supports, having a boss accommodating the insertion of said axle of said cylinder unit.

15. The apparatus of claim 14, with said cylinder pins fixed to said supports while said axle is rotatably inserted inside of said boss.

16. The apparatus of claim 12, with said swing gear disposed between said turntable of said bracket and said connecting plate of said main body.

17. The apparatus of claim 12, further comprising a center joint connected to a connecting plate fixed to said main body and a turntable of said bracket, having an inlet connected to an external fluid supply, an outlet connected to said cylinder, and a plurality of conduits formed on said center jointer.

18. The apparatus of claim 17, with said center joint comprising:

a fixed coupler inserted central holes formed on both said turntable and said connecting plate, fixed to said turntable, rotatably mounted on the hole of said connecting plate, having said inlet and a first conduit coupled to said inlet; and a moving coupler rotatably inserted into a hollow formed on said fixed coupler, having an outlet coupled to said cylinder and a second conduit coupled to said first conduit while said moving coupler rotates within said hollow of fixed coupler.

19. The apparatus of claim 18, with said moving coupler comprising a circular conduit formed on an outer circumferential surface of said moving coupler, coupling said first conduit of said fixed coupler to said second conduit of said moving coupler while said moving coupler rotates within said hollow of fixed coupler.

20. The apparatus of claim 18, further comprising a first stopper fixed to said connecting plate, having a protrusion inserted into a recess formed on outer circumferential surface of said fixed coupler.

21. The apparatus of claim 18, further comprising a second stopper fixed to said connecting plate of said main body, coupled to outer circumferential surface of said moving coupler.

22. The apparatus of claim 12, further comprising a ring inserted between said swing gear and said swing gear guide.

23. The apparatus of claim 18, further comprising a ring inserted between an out circumferential surface of said fixed coupler and an inner circumferential surface of said connecting plate.

24. A shearing apparatus, comprising:

a bracket;

a main body having a connecting plate rotatably coupled to said bracket, having a pair of supports extended from said connecting plate, a stationary arm fixed to said supports, a moving arm rotatably coupled to said supports, and a cylinder rotatably coupled to said supports and said moving arm;

a first coupler attached to said bracket, having a first conduit formed within said first coupler and connected to an external fluid source; and a second coupler attached to said connecting plate of said main body, rotating around said first coupler, and having a second conduit formed within said second coupler, said second conduit having one end connected to said cylinder of said main body and the other end connected to said first conduit of said first coupler without discontinuity between said first conduit and said second conduit while said second coupler rotates together with said connecting plate of said main body around said first coupler.

25. The apparatus of claim 24, further comprising an circular conduit formed on said first conduit of said first coupler, maintaining a connection between said first conduit and said second conduit while said second coupler rotates around said first coupler.

26. The apparatus of claim 25, further comprising a second circular conduit formed on another end of said second conduit, maintaining said connection between said first conduit and said second conduit while said second coupler rotates around said first coupler.

27. The apparatus of claim 24, further comprising:

said first coupler having a hollow cylindrical body;

said second coupler removably received by said first coupler; and said first conduit coupled to and communicated with said second conduit without discontinuity while said second coupler rotates around said first coupler.

28. The apparatus of claim 24, further comprising:

a motor attached to said bracket;

a pinion connected to and rotated by said motor;

a gear attached to said connecting plate of said main body and coupled to said pinion, rotating by said pinion; and a guide fixed said bracket, disposed on an outer circumferential surface of said gear and slidably coupled to said outer circumferential surface of said gear.

* * * * *